United States Patent [19]

Beckman

[11] 4,294,416

[45] Oct. 13, 1981

[54] CONTROLLED MULTIPACKAGE WINDING

[75] Inventor: John T. Beckman, Granville, Ohio

[73] Assignee: Owens-Corning Fiberglas Corporation, Toledo, Ohio

[21] Appl. No.: 132,473

[22] Filed: Mar. 19, 1980

[51] Int. Cl.[3] ..... B65H 54/08; B65H 54/30

[52] U.S. Cl. ..... 242/18 G; 65/2; 242/35.5 R; 242/43 R

[58] Field of Search ..... 242/18 G, 18 R, 18 B, 242/43 R, 35.5 R; 65/11 W, 2

[56] References Cited

U.S. PATENT DOCUMENTS 3,371,877 3/1968 Klink et al. ..... 242/18 G 3,771,324 11/1973 Klink et al. ..... 242/18 G X 3,801,032 4/1974 Sears et al. ..... 242/18 G X 3,897,021 7/1975 Shape ..... 242/18 G

*Primary Examiner*—Stanley N. Gilreath

*Attorney, Agent, or Firm*—Ronald C. Hudgens; Patrick P. Pacella; Paul T. Kashimba

[57] ABSTRACT

A method and apparatus for controlling the simultaneous winding of glass strands into more than one package by sensing when a first package has reached a predetermined size, sensing when a second package has reached a predetermined size, determining when a predetermined period of time has elapsed after one of the packages has been sensed and increasing the distance between the packages and the strand guides when either both packages have been sensed or the predetermined period of time has elapsed.

18 Claims, 5 Drawing Figures

CONTROLLED MULTIPACKAGE WINDING

BACKGROUND OF THE INVENTION

This invention relates to glass fiber production and, more particularly, to a method of controlling the simultaneous winding of glass strands into more than one package in a fiber forming process.

In the textile industry, linear filament bundles, such as yarn, strand and roving, are wound into packages by a winder; this practice is employed in winding linear filament bundles in synthetic filament forming operations, such as those producing glass filaments gathered into strands.

Modern winders are capable of simultaneously winding the strands into more than one package at a controlled linear collection speed. However, temperature variations in a cross section of the feeder supplying the molten glass streams from which the filaments are withdrawn can produce filaments having nonuniform diameters, even though the same linear strand collection speed is used for each package. Consequently, simultaneously wound packages are not always the same size during their formation. The prior art has attempted to solve this problem by employing a sensor to detect when the larger of at least two packages has reached a predetermined size during the formation of the packages. When the larger package has been sensed the guide member or builder arm is moved away from the packages. A winder utilizing this type of control is disclosed in Shape, U.S. Pat. No. 3,897,021, which is assigned to the assignee of the present invention. While the system of Shape gives highly satisfactory results and represents a marked improvement over the winding techniques previously known in the art, I have now discovered that even more accurate control of the package formation can be achieved by utilizing the control system of the present invention.

In order to obtain acceptable package build in a winding process, the guide means must maintain proper pressure on the forming package surface. This pressure is applied to the package surface through the strand guide-eye, cantilever spring, and cam, as disclosed in U.S. Pat. No. 3,897,021; such apparatus is commonly referred to as a builder. As the package diameter increases, the pressure on the package surface increases through the cantilever spring deflection until a "target" or "trip" magnet on the spring approaches a predetermined position, that is determined and sensed by a proximity switch. When this switch senses the target, it actuates the builder causing it to recede. Therefore, the pressure maintained on the package surface is a function of the builder back-off or receding rate and the cantilever spring constant.

Insufficient pressure will result in a package having flared ends, and excessive pressure will cause the package ends to bulge. An oscillation between insufficient pressure and excessive pressure will result in a package with ridged ends. To build an acceptable package, an optimum pressure range must be maintained on the package's surface. The back-off control system disclosed in Shape relies on an "OR" type logic system, i.e., the builder back-off rate is determined by the faster building package. Therefore, if there are temperature variations across the bushing, i.e., one half of the bushing is producing filaments of a larger diameter resulting in a heavier yardage than the other, the packages will have different diameter build rates. Consequently, the larger package causes the builder arm to back off before the smaller package has been built to a proper size; this results in the builder arm exerting insufficient pressure on the smaller package, thus causing the smaller package to have flared ends.

In addition to the problem of temperature variation across the bushing, the rate of package building decreases as the package builds, because of the increase in the diameter of the package. Prior art methods have merely moved the builder arm the same distance each time the larger package was sensed. Consequently, the prior art methods have not maintained a consistent pressure on the package throughout the building cycle.

Therefore, it is an object of this invention to provide a method of and apparatus for controlling the simultaneous winding of glass strands into more than one package in a filament forming operation such that the variance in the builder arm pressure on the simultaneously wound packages is reduced to a minimum, thereby providing packages of a uniform shape.

SUMMARY OF THE INVENTION

In accordance with the present invention, there is provided a method of controlling the simultaneous winding of linear elements into more than one package. The method comprises: (a) supplying at least two linear elements; (b) engaging the elements in a guide means; (c) forming the elements into at least a first and second package; (d) sensing when the first package is a predetermined size; (e) sensing when the second package is a predetermined size; (f) determining when a predetermined period of time has elapsed after one of the packages has been sensed; and (g) increasing the distance between the packages and the guide means when either the first and second packages have been sensed or the predetermined period of time has elapsed.

In addition, the invention provides an apparatus for controlling the simultaneous winding of linear elements into more than one package. The apparatus comprises: (a) means for supplying at least two linear elements; (b) means for forming the elements into at least a first and second package; (c) means for guiding the elements to the forming means, the guide means being located a predetermined distance from the forming means; (d) first means for sensing when the first package is a predetermined size; (e) second means for sensing when the second package is a predetermined size; (f) means responsive to the first and second sensing means for determining when a predetermined period of time has elapsed after one of the packages has been sensed; and (g) means responsive to the first and second sensing means and the determining means for increasing the distance between the packages and the guide means when either the first and second packages have been sensed or the predetermined period of time has elapsed.

The present invention is outstandingly adapted for the control of the package building process to ensure packages of essentially uniform build despite temperature variations across the bushing. The system of the present invention effects this control by utilizing sensors to determine when each package has attained a predetermined size and a timer that is responsive to the sensors to measure when a predetermined period of time has elapsed after one of the packages has been detected by its respective sensor. If the timer reaches the end of the time period before both packages have been sensed, the builder is moved away from the packages to prevent the exertion of excessive force on the larger package. Therefore, the subject system employs both "AND" and "OR" type logic to maintain uniform package build. If both packages reach a predetermined size within the predetermined time period, the AND logic moves the builder arm back. If one of the packages reaches a predetermined size and the other does not within a predetermined time period after the sensing of the first package, then the OR logic moves the builder arm to prevent excessive pressure on the larger package. Accordingly, the subject system maintains the pressure within a desired range. If desired, the system can also actuate an alarm and/or shut down the process in the event that both packages do not reach a predetermined size within the predetermined time period.

Still further, the method and apparatus of the present invention may include increasing the distance between the packages and the guide means as a function of the speed of rotation of the packages when either the first or second packages have been sensed or the predetermined period of time has elapsed. The functional relationship may be defined as a predetermined distance times the ratio of the actual rotational speed of the package at the beginning of building of the package to the actual speed of the package at the juncture at which the distance between the packages and the guide means is increased. Alternatively, the ratio may be defined in terms of the set point speed, i.e., the desired speed as determined by the speed curve within the memory of the microprocessor controller for the winder, or a combination of actual and set point speeds. By lessening the separation of the guide means and the packages as the packages become larger, the system of the present invention maintains a more consistent pressure on the package throughout the building cycle, thereby providing more uniform packages.

Other objectives, advantages and applications of the present invention will be made apparent by the following detailed description of the preferred embodiments of the invention.

DETAILED DESCRIPTION OF THE PREFERRED EMBODIMENTS

The method and apparatus of the present invention are particularly useful for controlling the simultaneous winding of glass strands into more than one package in processes for forming filaments of heat-softened mineral material, such as molten glass. However, those skilled in the art will readily recognize that the control system of the present invention is equally well applicable to other processes that simultaneously collect linear elements into more than one wound package. In addition, the winder described herein is illustrative of one type of winder incorporating the preferred embodiment of the control system of the present invention. Other types of winders can also be used; therefore, the winder described should be interpreted as exemplary and not in a limiting sense.

Figure 1:
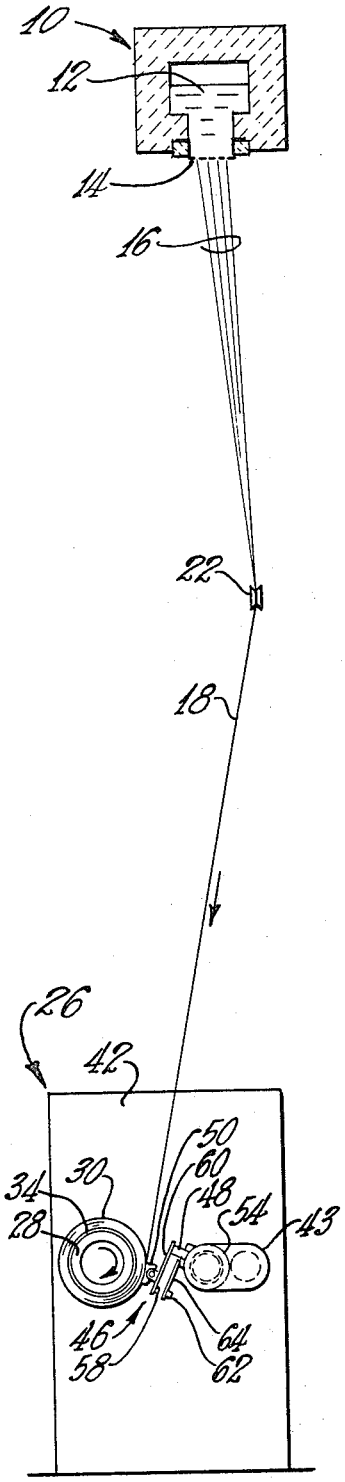
FIG. 1 is a front elevational view of a typical fiber forming apparatus.
Figure 2:
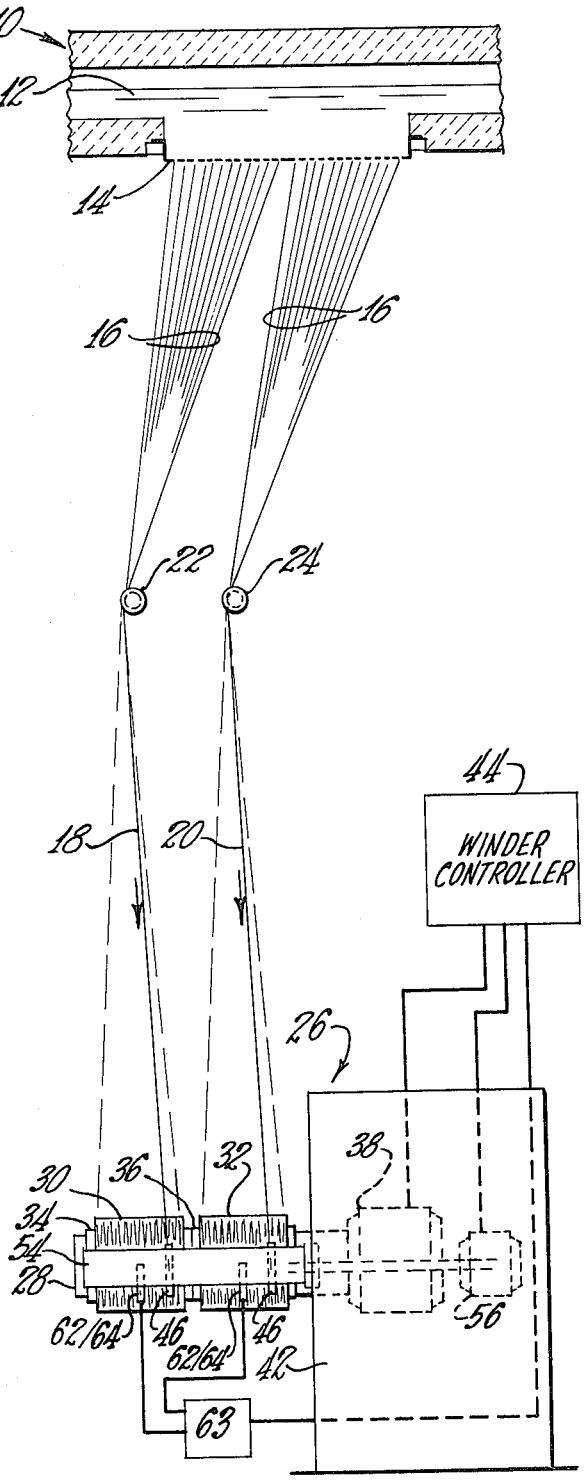
FIG. 2 is a side elevational and block diagram illustration of the fiber forming apparatus shown in FIG. 1.

Referring to FIGS. 1 and 2, a forehearth 10, which is connected to a glass melting furnace (not shown), supplies molten glass 12 to an electrically heated, fiber forming bushing 14, from which glass fibers 16 are attenuated, as is known in the art. Fibers 16 are combined into two strands, 18 and 20, as they are turned on gathering members 22 and 24 which are located below bushing 14. Gathering members 22 and 24 may apply sizing or other coating material to fibers 16 as is known in the art. A winder 26 located below gathering members 22 and 24 has a single, rotatably driven collet 28 for simultaneously collecting strands 18 and 20 into two generally cylindrically shaped side-by-side wound packages 30 and 32 on tubes 34 and 36, which are telescoped on collet 28. Variable speed drive 38, shown generally in housing 42 of winder 26, is operatively connected to collect 28 for rotation thereof. The speed and operation of drive 38 are controlled by winder controller 44.

A strand traversing apparatus, as described in detail in U.S. Pat. No. 3,897,021, the disclosure of which is hereby incorporated by reference, moves advancing strands 18 and 20, respectively, back and forth lengthwise of collet 28 so that the strands are distributed on packages 30 and 32. The strand traversing apparatus comprises: identical strand traversing assemblies 46, including strand engaging guides 50 at the circumferential surfaces of packages 30 and 32; and a movably mounted traversing means 54 for supporting strand traversing assemblies 46 and for moving such assemblies lengthwise of collet 28. Traversing means 54 is disposed horizontally with its longitudinal axis extending in a direction parallel to the axis of rotation of collet 28. Each of strand traversing assemblies 46 has a base 48 which is in slidable contact with traversing means 54. One end of spring member 60 is connected to base 48 such that spring member 60 is disposed downwardly from base 48. Strand engaging guide 50 is pivotally connected to the other end of spring member 60. Strand engaging guide 50 has a flat guide surface with a recess or slot for engaging the strand. In operation, strand guide 50 is reciprocated axially of its package with its guide surface lightly pressed against the circumferential surface of its package by spring member 60.

Traversing means 54 is operatively connected to drive means 56, which is located in housing 42. Housing 42 has an aperture 43 which allows drive means 56 to move traversing means 54 during formation of the packages to keep strand engaging guides 50 of strand traversing assemblies 46 at the circumferential surfaces of packages 30 and 32. The operation of drive means 56 is controlled by winder controller 44. A detailed description of drive means 56 and the operation thereof is disclosed in U.S. Pat. No. 3,897,021.

The means for sensing the size of the packages is identical for each package and may comprise an arrangement employing magnetically actuated reed switches and magnets, as disclosed in U.S. Pat. No. 3,897,021. Preferably, each sensing means comprises a piece of metallic tape 58 located on spring member 60 opposite strand engaging guide 50 and a metal proximity sensor 62 mounted on member 64 which is attached to traversing means 54. Members 64 are preferably attached to traversing means 54 at the mid-length of the reciprocation strokes of their respective strand engaging guides 50. A metal proximity sensor that is suitable for use in the FM Metal Responsive Sensor which is manufactured by Micro Switch, a division of Honeywell, located in Freeport, Ill. However, such sensor is given by way of example and not in a limiting sense; other methods of detecting the size of the package, such as those disclosed in U.S. Pat. No. 3,897,021 may be employed.

Each sensor 62 is connected to circuit 63 whereby the sensor signal is amplified, filtered and stretched to render it suitable for inputting to winder controller 44, as is known in the art. The output of circuit 63 is provided to winder controller 44.

Figure 3:
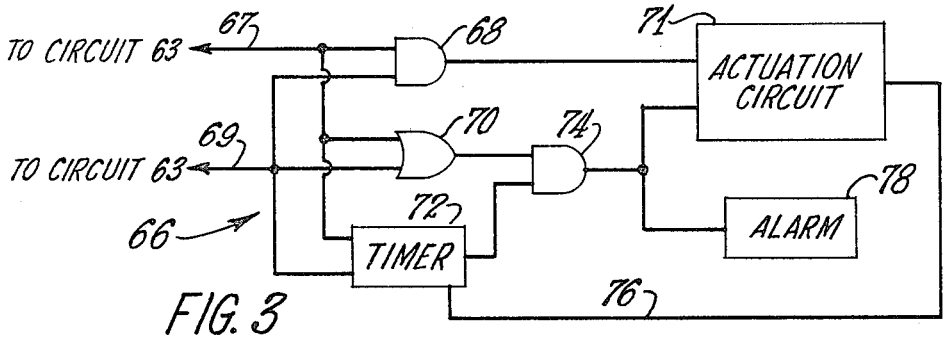
FIG. 3 is a block diagram of one embodiment of the electronic control circuit of the present invention as applied to the fiber forming apparatus of FIGS. 1 and 2.

Referring to FIG. 3, a circuit 66 for implementing the AND-OR logic control scheme of the present invention is disclosed. Control circuit 66 may be part of winder controller 44, as shown in FIG. 2, or may be a separate component of the system. Line 67 provides the output signal of sensor 62 associated with package 30 to one input of AND-gate 68, to one input of OR-gate 70, and to timer 72. Line 69 provides the output signal of sensor 62 associated with package 32 to the other input of AND-gate 68, to the other input of OR-gate 70, and to timer 72.

Timer 72 provides an output signal to one input of AND-gate 74 only when timer 72 has reached the end of a preset period of time; the output of OR-gate 70 is connected to the other input of AND-gate 74. Timer 72 receives a reset signal on lead 76 from actuation circuit 71 each time traversing means 54 is moved back. If desired, a separate timer may be provided for each sensor so that separate predetermined time periods may be set for each package. The outputs of AND-gate 68 and AND-gate 74 are provided to actuation circuit 71 to actuate drive means 56 for a predetermined period of time to move traversing means 54 away from packages 30 and 32. The predetermined period of time may be established by a timer, as described in U.S. Pat. No. 3,897,021, or preferably may be variable as a function of the speed of collet 28, as described hereinbelow.

In addition, AND-gate 74 provides a signal to alarm 78 to alert the operator that strand traversing assemblies 46 have been moved away from packages 30 and 32 before both packages have reached a predetermined size. Alarm 78 may be an individual alarm circuit or may be part of the circuitry of winder controller 44.

The operation of control circuit 66 can be described as follows. When either package 30 or 32 is detected by sensors 62, the appropriate line provides a signal to AND-gate 68, to OR-gate 70, and to timer 72. For example, assume that package 30 has been detected. If package 32 is detected before timer 72 has run for its preset time period, line 69 provides a signal to AND-gate 68, thus causing AND-gate 68 to provide an output signal to actuation circuit 71. The signal to actuation circuit 71 actuates drive means 56 for a predetermined period of time to move strand traversing assemblies 46 away from packages 30 and 32. In the event that sensor 62 does not detect package 32 before the preset time period of timer 72 has expired, timer 72 provides a signal on one input lead of AND-gate 74 and OR-gate 70 provides a signal on the other input of AND-gate 74, thereby causing AND-gate 74 to provide an output signal to actuation circuit 71 to actuate drive means 56. AND-gate 74 also provides a signal to alarm 78 to alert the operator that both packages have not reaches a predetermined size within the allotted time period. In an alternative embodiment, alarm 78 may take action to stop the process in addition to alerting the operator.

Figure 4:
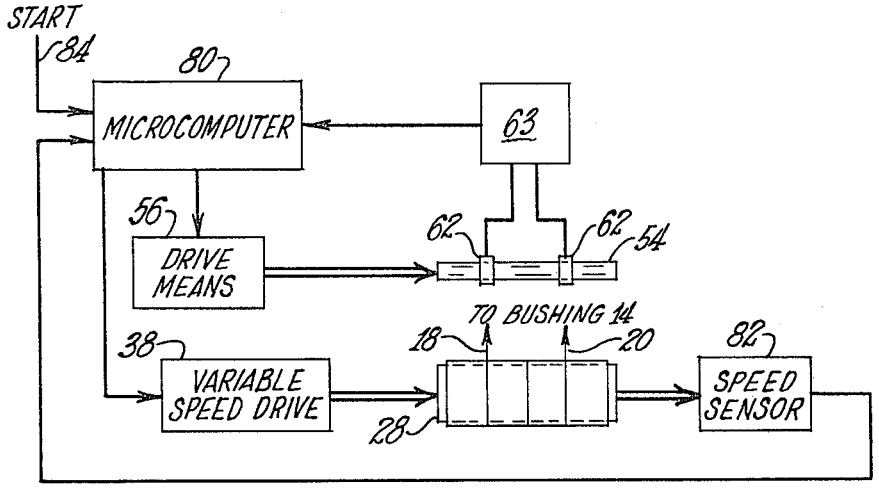
FIG. 4 is a schematic block diagram of the control system of the present invention in a microcomputer embodiment.

In the preferred embodiment, winder controller 44 is a microcomputer for controlling the winder speed, as disclosed in my U.S. Pat. No. 4,146,376, the disclosure of which is hereby incorporated by reference, and the associated control circuitry of control circuit 66, including the means for determining the variable period of time for energizing drive means 56, is implemented by the microcomputer. FIG. 4 discloses the implementation of the control system of the present invention in a microcomputer based system. Winder collet 28 collects strands 18 and 20 onto packages 30 and 32 (not shown) as described above. The speed of winder collet 28 is determined by variable speed drive 38 which is controlled by microcomputer 80. Variable speed drive 38 may comprise a constant speed motor coupled through a magnetic clutch which is electrically actuated and a clutch power control circuit which varies power to the magnetic clutch for regulating the speed of winder collet 28. The speed of winder collet 28 is sensed by speed sensor 82, and this signal is provided to microprocessor 80 which then computes an error signal between the actual winder collet speed and a desired winder collet speed and supplies this error signal to the clutch power control circuitry of variable speed drive 38.

Speed sensor 82 may comprise a tachometer pulse generator which provides a pulse output having a frequency proportional to the speed of winder collet 28 and a tachometer pulse counter for accumulating the output pulses from the tachometer pulse generator in a predetermined polling time. The polling time may be controlled by a programmable millisecond timer. After the tachometer pulses are accumulated in the tachometer pulse counter for a predetermined time interval, the digital contents of the pulse counter are shifted to microprocessor 80 for comparison with a desired winder collet speed. The desired winder collet speed may be stored in a memory in microcomputer 80 in the form of a digitized analog speed curve or it may be in the form of a polynomial formula which is solved for a time t from the beginning of a package on winder collet 28.

A start signal 84 is provided to microcomputer 80 either directly from winder collet 28 at the beginning of a package or manually when an operator starts a package. Microcomputer 80 continuously measures the time from the start of a package for use in determining a desired winder collet speed which is compared with the actual winder collet speed received from speed sensor 82. If desired, but not preferred, the actual present speed of collet 28 may be used rather than the set point speed from the speed curve stored in microcomputer 80. As described above, sensors 62 detect when packages 30 and 32 (not shown) have reached a predetermined size. The outputs of sensors 62 are provided to circuit 63 wherein the signals are manipulated for inputting to microcomputer 80. Microcomputer 80 is connected to drive means 56 which is mechanically connected to traversing means 54. Sensors 62 are mounted on traversing means 54 as described hereinabove.

Figure 5:
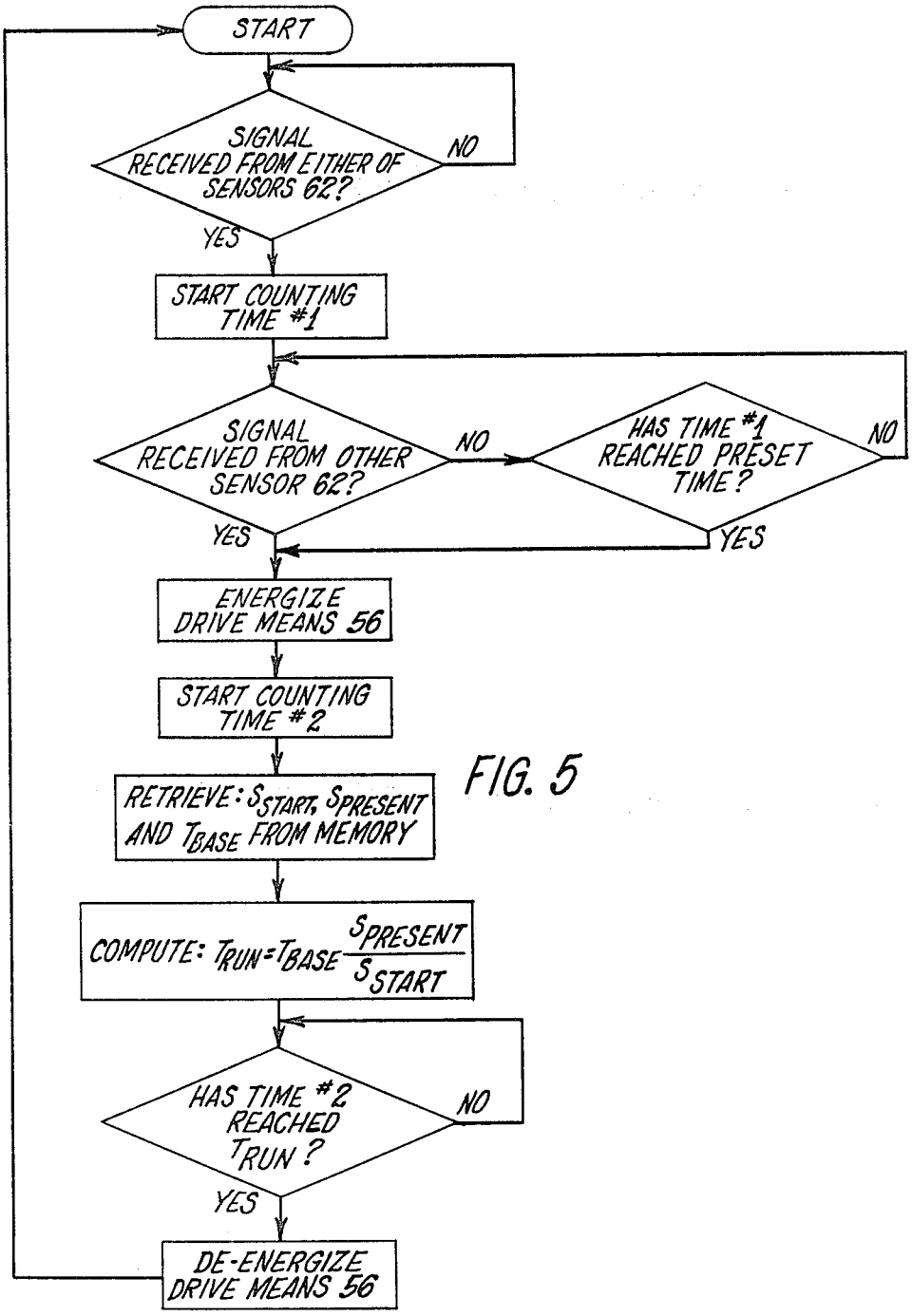
FIG. 5 is a flow chart for implementing the control system of the present invention in the microcomputer based system of FIG. 4.

FIG. 5 discloses a flow chart for implementing the control system shown in FIG. 4. When microcomputer 80 has received start signal 84, microcomputer 80 waits until it has received a signal from either of sensors 62 indicating that either package 30 or package 32 has reached a predetermined size. Microcomputer 80 then starts counting time until either the second package has been sensed or a first predetermined time has been reached. This first predetermined period of time may be preset and stored in the memory or may be variable as a function of the speed of collet 28, such as where it is inversely proportional to the speed of collet 28 and is calculated similarly to equation 1 set forth below. When either of the second package has been sensed or the time period has elapsed, microcomputer 80 energizes drive means 56 to move traversing means 54 away from the packages. Microcomputer 80 then starts counting a second predetermined time period which is calculated by using the equation $$t_{run} = t_{base} \frac{S_{present}}{S_{start}} \quad \text{(eq. 1)}$$

wherein $t_{run}$ is the time period that drive means 56 is to be energized, $t_{base}$ is the maximum amount of time that drive means 56 may be energized, $s_{present}$ is the present speed of collet 28, and $s_{start}$ is the speed of collet 28 at the start of package building. However, if desired, microcomputer 80 may energize drive means 56 and start counting $t_{run}$ when traversing means 54 has been moved enough so that one of sensors 62 no longer senses its respective package. When the second predetermined time period has run, drive means 56 is de-energized and microcomputer 80 again waits for a signal from either of sensors 62.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

I claim:

1. A method of controlling the simultaneous winding of linear elements into more than one package, said method comprising:

(a) supplying at least two linear elements;
(b) engaging said elements in a guide means;
(c) forming said elements into at least a first and second package;
(d) sensing when said first package is a predetermined size;
(e) sensing when said second package is a predetermined size;
(f) determining when a predetermined period of time has elapsed after one of said packages has been sensed; and
(g) increasing the distance between said packages and said guide means when either said first and second packages have been sensed or said predetermined period of time has elapsed.

2. A method as recited in claim 1, wherein said forming step comprises winding said elements into said packages and the distance in said increasing step is increased as a function of the speed at which said elements are wound into said packages.

3. A method of controlling the simultaneous winding of thermoplastic fibers into more than one package, said method comprising:

(a) feeding a supply of molten thermoplastic material through a plurality of orifices to form streams;
(b) attenuating said streams to form a plurality of fibers;
(c) engaging said fibers in a guide means;
(d) collecting said fibers into at least a first and second package;
(e) sensing when said first package is a predetermined size;
(f) sensing when said second package is a predetermined size;
(g) determining when a predetermined period of time has elapsed after one of said packages has been sensed; and
(h) increasing the distance between said packages and said guide means when either said first and second packages have been sensed or said predetermined period of time has elapsed.

4. A method as recited in claim 3, wherein said increasing step comprises moving said guide means away from said packages when either said first and second packages have been sensed or said predetermined period of time has elapsed.

5. A method as recited in claim 3, wherein said collecting step comprises winding said fibers into said packages and the distance in said increasing step is increased as a function of the speed at which said fibers are wound into said packages.

6. A method of controlling the simultaneous winding of glass strands into more than one package, said method comprising:

(a) feeding a supply of molten glass through a plurality of orifices to form glass streams;
(b) attenuating said glass streams to form a plurality of glass fibers;
(c) gathering said fibers into glass strands;
(d) forming said glass strands into at least a first and second wound package with said packages being disposed in end-to-end relationship on a single rotating spindle;
(e) reciprocating said strands lengthwise of said spindle by guide means with said guide means engaging said strands;
(f) sensing when said first package is a predetermined size;
(g) sensing when said second package is a predetermined size;
(h) determining when a predetermined period of time has elapsed after one of said packages has been sensed;
(i) moving said guide means away from said packages when either said first and second packages have been sensed or said predetermined period of time has elapsed.

7. A method as recited in claim 6, wherein the distance that said moving step moves said guide means away from said packages is a function of the rotational speed of said spindle.

8. A method as recited in claim 7, wherein said function is defined by the equation $$d = d_o \frac{S_{present}}{S_{start}}$$

wherein d: distance that said guide means is to be moved away from said packages;
$d_o$: maximum distance that said guide means is to be moved away from said packages;
$S_{present}$: rotational speed of said spindle at present; and $S_{start}$: rotational speed of said spindle at the beginning of forming said strands into said packages.

9. A method as recited in claim 8, wherein said method further comprises actuating an alarm if said guide means is moved before both of said packages have been sensed.

10. An apparatus for controlling the simultaneous winding of linear elements into more than one package, said apparatus comprising:

(a) means for supplying at least two linear elements;
(b) means for forming said elements into at least a first and second package;
(c) means for guiding said elements to said forming means, said guide means being located a predetermined distance from said forming means;
(d) first means for sensing when said first package is a predetermined size;
(e) second means for sensing when said second package is a predetermined size;
(f) means responsive to said first and second sensing means for determining when a predetermined period of time has elapsed after one of said packages has been sensed; and
(g) means responsive to said first and second sensing means and said determining means for increasing the distance between said packages and said guide means when either said first and second packages have been sensed or said predetermined period of time has elapsed.

11. An apparatus as recited in claim 10, wherein said forming means comprises means for winding said elements into said packages, and said increasing means is responsive to said winding means and increases said distance as a function of the speed at which said elements are wound into said packages.

12. An apparatus for controlling the simultaneous winding of thermoplastic strands into more than one package, said apparatus comprising:

(a) means for supplying streams of molten thermoplastic material for attenuation into thermoplastic fibers;
(b) means for gathering said fibers into strands;
(c) means for forming said strands into at least a first and second package;
(d) means for guiding said strands to said forming means, said guide means being located a predetermined distance from said forming means;
(e) first means for sensing when said first package is a predetermined size;
(f) second means for sensing when said second package is a predetermined size;
(g) means responsive to said first and second sensing means for determining when a predetermined period of time has elapsed after one of said packages has been sensed; and
(h) means responsive to said first and second sensing means and said determining means for increasing the distance between said packages and said guide means when either said first and second packages have been sensed or said predetermined period of time has elapsed.

13. An apparatus as recited in claim 12, wherein said forming means comprises means for winding said strands into said packages, and said increasing means is responsive to said winding means and increases said distance as a function of the speed at which said strands are wound into said packages.

14. An apparatus as recited in claim 12, wherein said increasing means comprises means connected to said guide means for moving said guide means away from said packages.

15. An apparatus for controlling the simultaneous winding of glass strands into more than one package, said apparatus comprising:

(a) means for supplying streams of molten glass;
(b) means for attenuating said streams into fibers and for collecting said fibers into at least a first and second wound package, said means comprising a rotating spindle with said first and second packages being disposed in end-to-end relationship on said spindle;
(c) guide means located a predetermined distance from said spindle for engaging said fibers and reciprocating them lengthwise of said spindle;
(d) first means for sensing when said first package is a predetermined size;
(e) second means for sensing when said second package is a predetermined size;
(f) means responsive to said first and second sensing means for determining when a predetermined period of time has elapsed after one of said packages has beensensed;
(g) means connected to said guide means and responsive to said first and second sensing means and said determining means for moving said guide means away from said packages when either said first and second packages have been sensed or said predetermined period of time has elapsed.

16. An apparatus as recited in claim 15, wherein the distance that said moving means moves said guide means is a function of the rotational speed of said spindle.

17. An apparatus as recited in claim 16, wherein said function is defined by the equation $$d = d_o \frac{S_{present}}{S_{start}}$$

where d: distance that said guide means is to be moved away from said packages;
$d_o$: maximum distance that said guide means is to be moved away from said packages;
$S_{present}$: rotational speed of said spindle at present; and
$S_{start}$: rotational speed of said spindle at the beginning of the collecting of said fibers into said packages.

18. An apparatus as recited in claim 17, wherein said apparatus further comprises means responsive to said first and second sensing means and said moving means for actuating an alarm if said guide means is moved away from said packages before said first and second packages are sensed.

* * * * *